US010267127B2

(12) United States Patent
Geerts et al.

(10) Patent No.: US 10,267,127 B2
(45) Date of Patent: Apr. 23, 2019

(54) EFP DETONATING CORD

(71) Applicant: OWEN OIL TOOLS LP, Houston, TX (US)

(72) Inventors: Shaun M. Geerts, Crowley, TX (US); Matthew C. Clay, Burleson, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 265 days.

(21) Appl. No.: 15/246,175

(22) Filed: Aug. 24, 2016

(65) Prior Publication Data

US 2017/0058648 A1 Mar. 2, 2017

Related U.S. Application Data

(60) Provisional application No. 62/209,717, filed on Aug. 25, 2015.

(51) Int. Cl.

| | |
|---|---|
| ***E21B 43/117*** | (2006.01) |
| ***E21B 43/118*** | (2006.01) |
| ***C06C 5/04*** | (2006.01) |
| ***F42B 1/028*** | (2006.01) |
| ***F42D 1/22*** | (2006.01) |
| ***F42D 3/00*** | (2006.01) |
| ***E21B 43/1185*** | (2006.01) |
| ***F42B 1/02*** | (2006.01) |
| ***F42B 3/08*** | (2006.01) |
| ***F42C 19/09*** | (2006.01) |

(52) U.S. Cl.

CPC ..... *E21B 43/117* (2013.01); *C06C 5/04* (2013.01); *E21B 43/118* (2013.01); *E21B 43/1185* (2013.01); *F42B 1/02* (2013.01); *F42B 1/028* (2013.01); *F42B 3/08* (2013.01); *F42C 19/09* (2013.01)

(58) Field of Classification Search

CPC .. E21B 43/117; E21B 43/118; E21B 43/1185; C06C 5/04; F42B 1/02; F42B 1/028; F42B 3/08; F42C 19/09; F42D 1/22; F42D 3/00

See application file for complete search history.

(56) References Cited

U.S. PATENT DOCUMENTS

| | | | |
|---|---|---|---|
| 2,664,157 | A | 12/1953 | Abendroth |
| 3,032,108 | A | 5/1962 | Bielstein |
| 3,095,038 | A | 6/1963 | Thompson et al. |

(Continued)

FOREIGN PATENT DOCUMENTS

| | | | |
|---|---|---|---|
| EP | 0808446 | A1 | 11/1997 |
| GB | 2206400 | A | 1/1989 |
| WO | WO96/23192 | A1 | 11/1997 |

OTHER PUBLICATIONS

PCT/US2016/048657—International Search Report and Written Opinion dated Dec. 1, 2016.

*Primary Examiner* — Daniel P Stephenson
(74) *Attorney, Agent, or Firm* — Mossman, Kumar & Tyler, PC

(57) ABSTRACT

A perforating tool includes an encapsulated shaped charge that has a bulkhead with a reduced wall thickness section, a plate having a shallow recess, and a detonating cord having an energetic core. The energetic core forms the plate into an explosively formed perforator when detonated. The plate is positioned to direct the explosively formed perforator into the reduced wall thickness section.

17 Claims, 3 Drawing Sheets

(56) References Cited

U.S. PATENT DOCUMENTS

| | | | | | |
|---|---|---|---|---|---|
| 3,104,611 | A | | 9/1963 | Baks | |
| 3,146,710 | A | | 9/1964 | Atwood | |
| 3,276,369 | A | | 10/1966 | Bell | |
| 3,361,204 | A | | 1/1968 | Howard et al. | |
| 3,414,071 | A | | 12/1968 | Alberts | |
| 3,417,827 | A | | 12/1968 | Smith et al. | |
| 3,419,088 | A | | 12/1968 | Gray | |
| 3,441,095 | A | | 4/1969 | Arthur | |
| 3,835,889 | A | | 9/1974 | Hyde | |
| 4,253,523 | A | * | 3/1981 | Ibsen | E21B 43/117 102/310 |
| 4,393,946 | A | | 7/1983 | Pottier et al. | |
| 4,496,008 | A | | 1/1985 | Pottier et al. | |
| 4,519,313 | A | | 5/1985 | Leidel | |
| 4,532,986 | A | | 8/1985 | Mims et al. | |
| 4,598,775 | A | | 7/1986 | Vann et al. | |
| 4,627,353 | A | * | 12/1986 | Chawla | F42B 1/02 102/307 |
| 4,716,832 | A | | 1/1988 | Sumner | |
| 4,739,839 | A | | 4/1988 | Regalbuto et al. | |
| 4,753,170 | A | | 6/1988 | Regalbuto et al. | |
| 5,095,801 | A | | 3/1992 | Lopez | |
| 5,383,405 | A | * | 1/1995 | Everest | C06C 5/04 102/275.8 |
| 6,053,248 | A | | 4/2000 | Ross | |
| 6,260,622 | B1 | | 7/2001 | Blok et al. | |
| 2014/0123841 | A1 | | 5/2014 | Clay et al. | |
| 2017/0058648 | A1 | * | 3/2017 | Geerts | E21B 43/117 |

* cited by examiner

EFP DETONATING CORD

CROSS REFERENCE TO RELATED APPLICATIONS

This application claims priority from U.S. Provisional Application Ser. No. 62/209,717, filed on Aug. 25, 2015, the entire disclosure of which is incorporated herein by reference in its entirety.

TECHNICAL FIELD

The present disclosure relates to devices and methods for perforating a subterranean formation.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun that is generally comprised of a steel tube "carrier," a charge tube riding on the inside of the carrier, and with shaped charges positioned in the charge tube. The gun is lowered into the wellbore on electric wireline, slickline, tubing, coiled tubing, or other conveyance device until it is adjacent to the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

The present disclosure addresses the continuing need for enhancing the operation of perforating tools.

SUMMARY

In aspects, the present disclosure provides a perforating tool for use in a wellbore. The perforating tool may include a conveyance device, a carrier, a plurality of encapsulated shaped charges, a detonating cord, and plates. The carrier is connected to the conveyance device and has a plurality of encapsulated shaped charges positioned thereon. Each encapsulated shaped charge may include a bulkhead having a reduced wall thickness section. The detonating cord has a sheath surrounding an energetic core and is energetically coupled to the plurality of encapsulated shaped charges. The plates have a shallow recess. One plate is positioned between the detonating cord and the reduced wall thickness section of each encapsulated shaped charge. The energetic core forms the plate into a explosively formed perforator when detonated. The encapsulated shaped charge and detonating cord may be in contact with a borehole liquid in the wellbore.

In another aspect, a perforating tool for use in a wellbore may include an encapsulated shaped charge, a plate, and a detonating cord. The encapsulated shaped charge includes a bulkhead having a reduced wall thickness section. The plate has a shallow recess. The detonating cord has an energetic core that forms the plate into a explosively formed perforator when detonated. The plate is positioned between the energetic core and the reduced wall thickness section.

In further aspects, the present disclosure provides a method of perforating a subterranean formation. The method includes connecting a carrier to a conveyance device. The carrier includes a perforating arrangement as described above. The method further includes conveying the carrier into a wellbore intersecting the subterranean formation using the conveyance device, wherein the encapsulated shaped charges and detonating cord are in contact with a borehole liquid in the wellbore; rotating the encapsulated shaped charges from a compact position to a firing position, wherein the compact position and the firing position have at least a forty five degree offset; and detonating the encapsulated shaped charges using the detonating cord.

It should be understood that certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
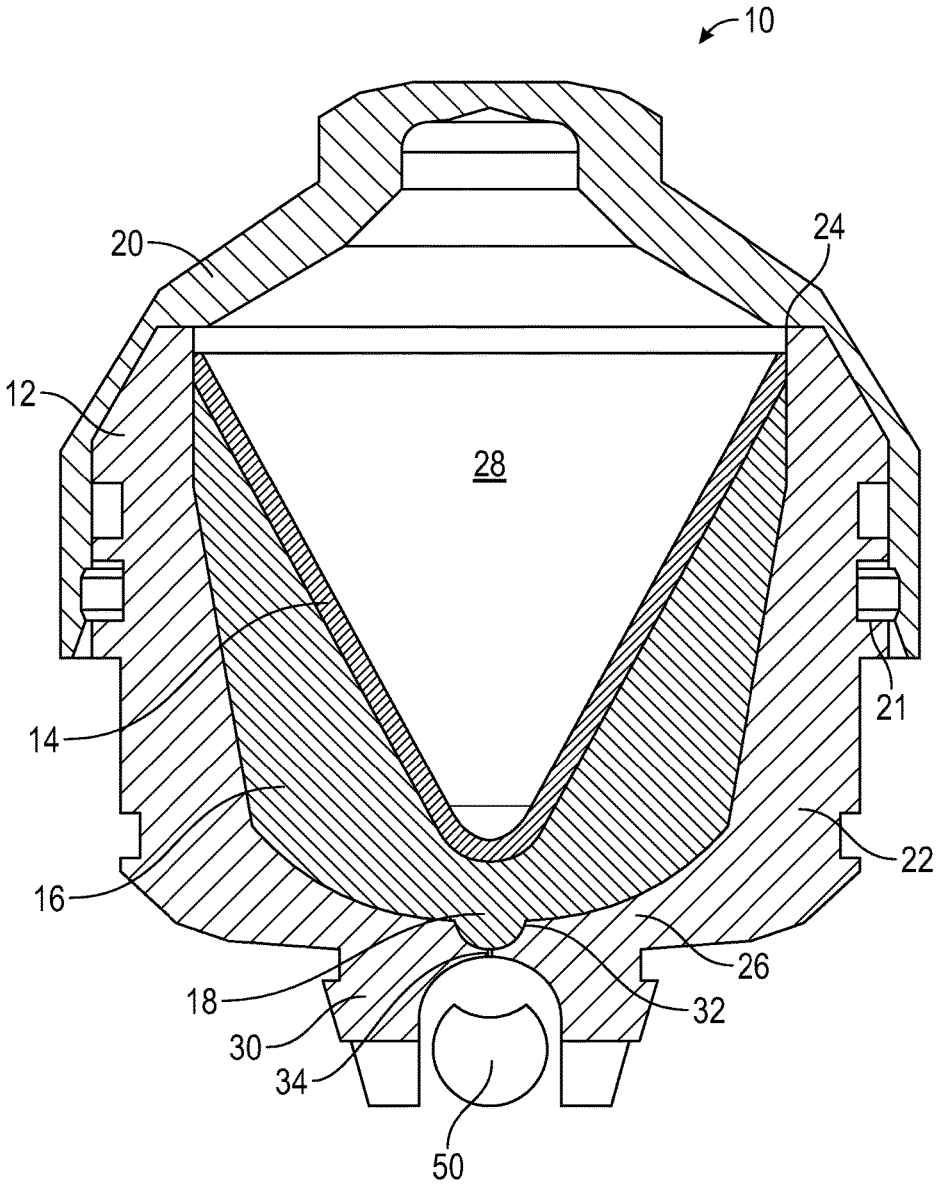
FIG. 1 illustrates a side sectional view of an encapsulated shaped charge that may be used in connection with the present disclosure.

The present disclosure relates to devices and methods for perforating a formation intersected by a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is sectionally shown one embodiment of an encapsulated shaped charge 10 that may be used in accordance with the present disclosure. Generally speaking, the encapsulated shaped charge 10 is designed to isolate the internal components from the wellbore environment (e.g., wellbore pressure and contact with wellbore fluids). The encapsulated shaped charge 10 may include a case 12, a liner 14, a primary explosive 16, a secondary explosive 18, and a cap 20. The internal components isolated by the cap 20 principally include the liner 14 and the explosives 16, 18.

The case 12 may be formed as a cylindrical body 22 having a mouth 24 at one end and a bulkhead 26 at the other end. The mouth 22 provides the only access into an interior space 28. The liner 14 covers the mouth 22 and secures the explosives 16, 18 in the interior space 28. The bulkhead 26 is a portion of the body 24 that includes an external slot 30 and one or more internal recesses 32. The external slot 30 may have a "U" shape for receiving a detonating cord 50, which will be discussed in greater detail below. The internal recess 32 may be a groove, indentation, channel, or other feature that forms a reduced thickness portion 34 at the bulkhead 26. Because the wall of the bulkhead 26 is thinner at the reduced thickness portion 34 relative to the immediately adjacent areas, the bulkhead 26 is structurally weakened at the reduced thickness portion 34.

When detonated, the primary and secondary explosives 16, 18 cooperate to form a perforating jet from the liner 14. The primary explosive 16 is positioned next to the liner 14 and the secondary explosive 18 is positioned between the primary explosive 16 and the bulkhead 26. The primary explosive 16 may include a high explosive, such as RDX, HMX and HNS, which is formulated to generate the heat, pressure, and shock waves for forming a perforating jet from the liner 14. The secondary explosive 18 may be include one or more explosive materials that enable the secondary explosive 18 to detonate the primary explosive 16. For convenience, the secondary explosive 18 will be referred to as a "booster."

Pressure isolation for the interior of the shaped charge 10 is created by attaching the cap 20 to the case 12. In embodiments, sealing elements 21 may be used to form a fluid-tight barrier between the cap 20 and the case 12. This fluid-tight barrier provides a sealed space for the internal components such as the liner 14 and explosives 16, 18. It should be noted that the case 12 is perforation-free: i.e., the case 12 does not have any passages or openings that penetrate completely through the case 12 to provide access to the booster 16. Thus, the booster 16 must be detonated by transmitting a suitable shockwave through the bulkhead 28. In embodiments according to the present disclosure, the detonating cord 50 is configured to detonate the booster 18 by puncturing the reduced wall section 34 and directing shock waves and thermal energy to the booster 18.

Figure 2:
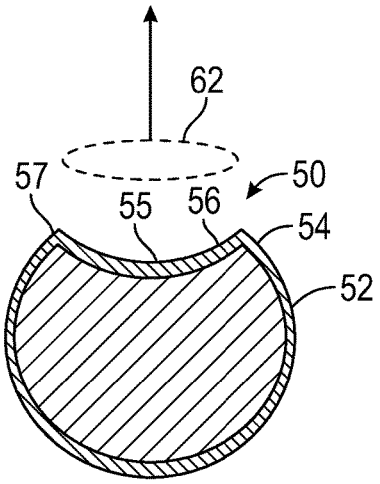
FIGS. 2 and 3 illustrate a cross-sectional view and an isometric view of a detonating cord that may used to detonate the FIG. 1 shaped charge according to one embodiment of the present disclosure.
Figure 3:
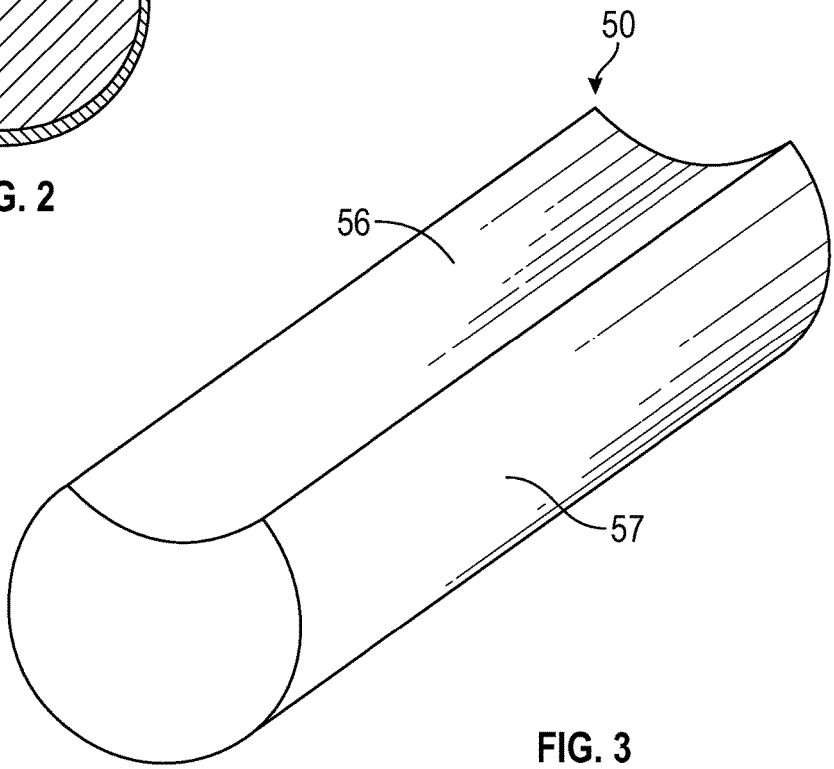

Referring now to FIGS. 2 and 3, there is shown the detonating cord 50 in greater detail. In one embodiment, the detonating cord 50 includes a core 52 formed of an energetic material and a metal sheath 54. The sheath 54 uses multiple surface geometries in order to generate an explosively formed perforator (EFP). In one embodiment, a portion of sheath 54 is shaped to produce the Misznay-Schardin effect. Projectiles formed under the Misznay-Schardin effect are commonly called Explosively Formed Penetrators (EFPs). EFPs travel much more slowly (~1 km/sec.) than the jet of a conventional shaped charge. Generally speaking, the Misznay-Schardin effect may be produced by a plate 55 having a shallow recess 56 having one or more curved and/or flat surfaces arranged such that a large fraction (90-100%) of the material making up the plate 55 is propelled to cause a wide and shallow perforation into the reduced thickness portion 34 (FIG. 1). For the purposes of this disclosure, "shallow" means that the recess 56 has a diameter/width to depth ratio of greater than two to one. A "diameter" applies if the recess is shaped as a circle and a width applies if the recess has a non-circular shape. For the non-circular shape, the relevant measurement is the size of the largest width of the shape. In some embodiments, the diameter/width to depth ratio may be six to one or greater.

In one arrangement, the concave recess 56 may be formed as a linear groove that runs axially along an external surface 57 of the sheath 54 of the detonating cord 50. As shown, the groove may have a cross-sectional profile that conforms to an arc. In other embodiments, the groove may have a "V" shape (triangular cross-sectional shape). The concave recess 56 is not necessarily a straight axially elongated depression. For instance, the recess 56 may be a spherical, shallow curved hollow, a shallow pyramid indentation, or a shallow concave arcuate shaped cavity.

Referring to FIGS. 1 and 2, the detonating cord 50 seats within the external slot 30 and is positioned be immediately adjacent to the reduced thickness portion 34. The plate 55 directly faces the reduced thickness portion 34, which aims the generated EFP, shown with hidden lines and numeral 62, at the reduced thickness portion 34.

Referring to FIGS. 1-3, during use, the detonating cord 50 is energetically coupled to the case 12 at the external slot 30 and the plate 55 is positioned to direct an EFP 62 to the reduced thickness portion 34. By energetically coupled, it is meant that the detonation energy of the detonating cord 50 is transferred with sufficient magnitude to detonate the shaped charge. Thereafter, the encapsulated shaped charge 10 is conveyed into a wellbore (not shown) and positioned at a target depth. When desired, the detonating cord 50 is detonated. The shockwave and heat generated by the core 52 forms the plate 55 into the EFP 62. The EFP 62 punctures the reduced thickness portion 34 and thereby forms an opening through which the explosive energy generated by the core 52 can access and detonate the booster 18. Upon detonation, the booster 18 detonates the primary explosive 16, which then creates a perforating jet used to perforate a wellbore tubular and/or a formation.

Figure 4:
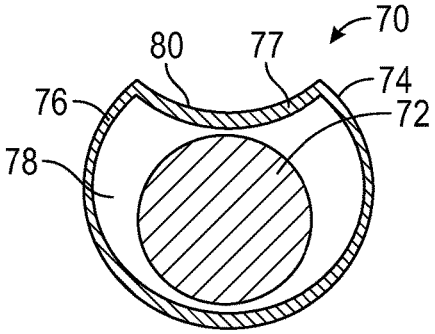
FIG. 4 illustrates a cross-sectional view of a detonating cord assembly that may used to detonate the FIG. 1 shaped charge according to one embodiment of the present disclosure.

Referring to FIG. 4, there is shown another arrangement for generating an EFP to perforate the reduced thickness portion 34 (FIG. 1). The EFP may be formed by an assembly 70 that includes a detonating cord 72 positioned inside a tubular enclosure 74. The detonating cord 72 may be of conventional design (e.g., circular, rectangular, etc.). The tubular enclosure 74 may be metal tubing that isolates the detonating cord 72 from ambient pressure and contact with the wellbore environment (e.g., well fluids). The tubular enclosure 74 includes a wall 76 defining a bore 78 in which the detonating cord 72 resides. A portion of the wall 76 includes a plate 77 that has a concave recess 80. The concave recess 80 may be configured and positioned in the same manner as the concave recess 56 (FIG. 2). Thus, when the detonating cord 72 is detonated, the plate 77 generates an EFP that penetrates and perforates the reduced thickness section 34 (FIG. 1).

Figure 5A:
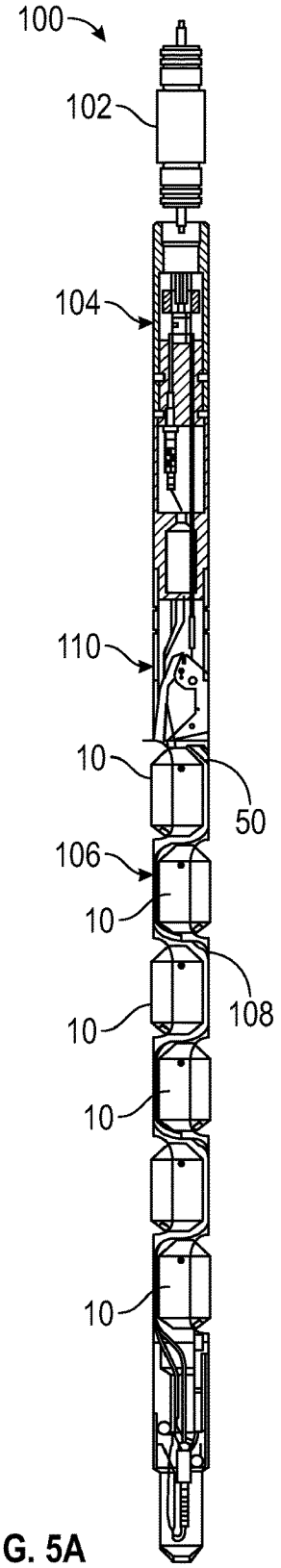
FIGS. 5A and 5B sectionally illustrate a perforating tool that may be used with embodiments of the present disclosure.
Figure 5B:
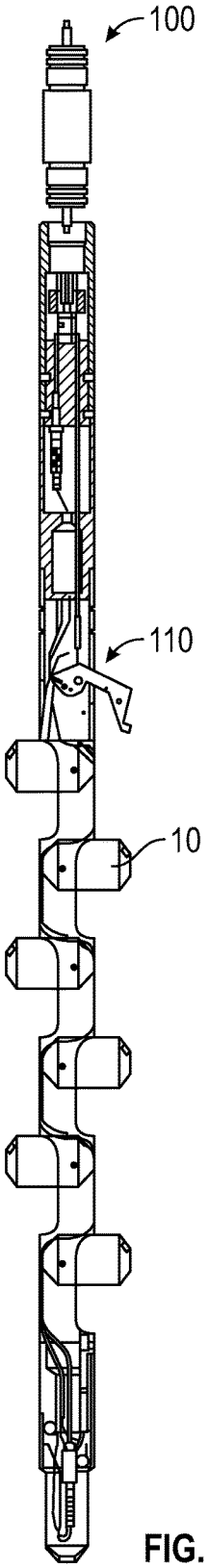

The devices, systems, and methods of the present disclosure may be advantageously applied to any number of perforating guns used to perforate a well. FIGS. 5A-B illustrate one non-limiting arrangement that includes a perforating gun 100 that is conveyed by a conveyance device 102. The conveyance device 102 may be a wireline, a slickline, e-line, coiled tubing, or a drill string.

The perforating gun 100 includes a firing connection assembly 104 and a carrier 106. The carrier 106 is a frame-like structure on which the shaped charges 10 are connected. The detonating cord 50 energetically connects the firing connection assembly 104 to the shaped charges 50. It should be noted that the carrier 106 does not enclose the shaped charges 10 and detonating cord 50. Thus, the shaped charges 10 and detonating cord 50 are exposed to surrounding borehole liquids such as drilling mud and formation fluids. However, as described above, the shaped charges 10 and detonating cord 50 are configured to be liquid tight and protected from harmful contact with ambient fluids and pressure.

In the illustrated embodiment, the shaped charges 10 of the perforating 100 rotate from a compact position to a firing position. As shown in FIG. 5A, in the compact position, the shaped charges 10 point along the longitudinal axis of the perforating gun 100. As shown in FIG. 5B, in the firing position, the shaped charges 10 rotate to point radially outward from the perforating gun 100. The rotation may be about ninety degrees. By "pointing," it is meant the direction the perforating jet formed by the shaped charges 10 would travel upon detonation. In one arrangement, each shaped charge 10 may include a spring mechanism 108, one of which has been labeled, that applies a spring force for rotating each shaped charge 10. A trigger assembly 110 may be used to maintain the shaped charges 10 in the compact position during travel. When activated, as shown in FIG. 5B, the trigger assembly 110 releases the shaped charges 10, which then are free to rotate to a firing position. The compact position and the firing position can have an angular offset of at least 15 degrees, at least 30 degrees, at least 45 degrees, at least 60 degrees, at least 75 degrees, or 90 degrees. Thereafter, the shaped charges 10 can be fired as described above.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A perforating tool for use in a wellbore, comprising:
a conveyance device;
a carrier connected to the conveyance device;
a plurality of encapsulated shaped charges positioned on the carrier, each encapsulated shaped charge including a bulkhead having a reduced wall thickness section;
a detonating cord having a sheath surrounding an energetic core, the detonating cord being energetically coupled to the plurality of encapsulated shaped charges; and
a plurality of plates having a shallow recess, wherein one plate of the plurality of plates is positioned between the detonating cord and the reduced wall thickness section of each encapsulated shaped charge, wherein the energetic core form the plate into a explosively formed perforator when detonated, and wherein the recess has a diameter/width to depth ratio of greater than two to one,
wherein the encapsulated shaped charge and detonating cord are in contact with a borehole liquid in the wellbore.

2. The perforating tool of claim 1, wherein each plate is a section of the sheath and the recess is formed as a concave linear groove that runs axially along an external surface of the sheath.

3. The perforating tool of claim 2, wherein the recess is formed as one of: (i) an arc, and (ii) V-shape.

4. The perforating tool of claim 1, wherein the energetic core and wherein each plate is a section of a tubular enclosure in which the detonating cord is disposed.

5. The perforating tool of claim 1, wherein the plurality of encapsulated shaped charges are rotatable between a compact position and a firing position, and wherein the compact position and the firing position have at least a forty five degree offset.

6. A perforating tool for use in a wellbore, comprising:
an encapsulated shaped charge, the encapsulated shaped charge including a bulkhead having a reduced wall thickness section;
a plate having a shallow recess, wherein the recess has a diameter/width to depth ratio of greater than two to one; and
a detonating cord having an energetic core, the energetic core forming the plate into a explosively formed perforator when detonated, wherein the plate is positioned between the energetic core and the reduced wall thickness section.

7. The perforating tool of claim 6, further comprising a carrier on which the encapsulated shaped charge and detonating cord are disposed, the encapsulated shaped charge and detonating cord being in contact with a borehole liquid in the wellbore.

8. The perforating tool of claim 6, further comprising a sheath surrounding the energetic core.

9. The perforating tool of claim 8, wherein the plate is a section of the sheath.

10. The perforating tool of claim 8, wherein the recess is formed as a concave linear groove that runs axially along an external surface of the sheath.

11. The perforating tool of claim 10, wherein the recess is formed as one of: (i) an arc, and (ii) V-shape.

12. The perforating tool of claim 6, wherein the detonating cord includes a sheath surrounding the energetic core and wherein the plate is a section of a tubular enclosure in which the detonating cord is disposed.

13. A method of perforating a subterranean formation, comprising:
connecting a carrier to a conveyance device, the carrier including:
a plurality of an encapsulated shaped charges positioned on the carrier, each encapsulated shaped charge including a bulkhead having a reduced wall thickness section;
a detonating cord having a sheath surrounding an energetic core, the detonating cord being energetically coupled to the plurality of encapsulated shaped charges; and
a plurality of plates having a shallow recess, wherein one plate of the plurality of plates is positioned between the detonating cord and the reduced wall thickness section of each encapsulated shaped charge, wherein the energetic core form the plate into a explosively formed perforator when detonated, and wherein the recess has a diameter/width to depth ratio of greater than two to one,
conveying the carrier into a wellbore intersecting the subterranean formation using the conveyance device, wherein the encapsulated shaped charges and detonating cord are in contact with a borehole liquid in the wellbore;
rotating the encapsulated shaped charges from a compact position to a firing position, wherein the compact position and the firing position have at least a forty five degree offset; and
detonating the encapsulated shaped charges using the detonating cord.

14. A perforating tool for use in a wellbore, comprising:
an encapsulated shaped charge, the encapsulated shaped charge including a bulkhead having a reduced wall thickness section;
a tubular enclosure having a concave recess on an outer surface; and a detonating cord including a sheath surrounding an energetic core, wherein a material between the recess and the detonating cord defines a plate, wherein the energetic core forms the plate into an explosively formed perforator when detonated, and wherein the plate is positioned to direct the explosively formed perforator into the reduced wall thickness section.

15. The perforating tool of claim 14, wherein the recess is formed as one of: (i) an arc, and (ii) V-shape.

16. A perforating tool for use in a wellbore, comprising:

an encapsulated shaped charge, the encapsulated shaped charge including a bulkhead having a reduced wall thickness section; and a detonating cord having a sheath surrounding an energetic core, wherein a section of the sheath between the energetic core and the reduced wall thickness includes a concave recess that defines a plate, wherein the energetic core forms the plate into an explosively formed perforator when detonated, and wherein the plate is positioned to direct the explosively formed perforator into the reduced wall thickness section.

17. The perforating tool of claim 16, wherein the recess is formed as one of: (i) an arc, and (ii) V-shape.

* * * * *